US005535690A

United States Patent [19]

Bystedt et al.

[11] Patent Number: 5,535,690

[45] Date of Patent: Jul. 16, 1996

[54] PITCH STABILIZED DISPLACEMENT VESSEL

[75] Inventors: Stig Bystedt, Uddevalla; Orvar Toreskog, Alingsås, both of Sweden

[73] Assignee: Stena Rederi AB, Göteborg, Sweden

[21] Appl. No.: 360,831

[22] PCT Filed: Jun. 30, 1993

[86] PCT No.: PCT/SE93/00595

§ 371 Date: Mar. 14, 1995

§ 102(e) Date: Mar. 14, 1995

[87] PCT Pub. No.: WO94/01323

PCT Pub. Date: Jan. 20, 1994

[30] Foreign Application Priority Data

Jul. 9, 1992 [SE] Sweden ..... 9202130

[51] Int. Cl.[6] ..... B63B 1/04; B63B 1/10

[52] U.S. Cl. ..... 114/61; 114/56; 114/126

[58] Field of Search ..... 114/126, 61, 56, 114/142

[56] References Cited

U.S. PATENT DOCUMENTS

| | | | |
|---|---|---|---|
| 3,896,755 | 7/1975 | Marbury | 114/126 |
| 3,897,744 | 8/1975 | Lang | 114/61 |
| 5,269,245 | 12/1993 | Bystedt et al. | 114/56 |

FOREIGN PATENT DOCUMENTS

| | | | |
|---|---|---|---|
| 0108004 | 5/1984 | European Pat. Off. . | |
| 0352195 | 1/1990 | European Pat. Off. . | |
| 140793 | 12/1978 | Japan | 114/61 |
| 77590 | 4/1986 | Japan | 114/126 |
| 47169 | 11/1929 | Norway | 114/126 |
| 9100288-1 | 9/1994 | Sweden . | |
| 4718 | of 1913 | United Kingdom | 114/61 |

*Primary Examiner*—Sherman Basinger
*Attorney, Agent, or Firm*—Keck, Mahin & Cate

[57] ABSTRACT

A pitch stabilized vessel includes at least one displacement hull constructed for high propulsion speeds of, for instance, 35 knots. The hull is configured so as to locate the pitching center of the vessel far forwards on the hull, for instance, at a point corresponding to 75% of the length of the hull from the stern thereof. Generally horizontal and elongated fins extend along the hull and project out from the actual hull in the stern half thereof. The fins extend from the stern-edge of the hull through a distance corresponding to one-third of the length of the hull. The fins have a total horizontally projected surface area which corresponds to at least 5% of W/d, where W is the total underwater volume at construction draft and d is the hull construction draft. The total horizontally projected area of all fins provided on the type of vessel concerned is at least 5% of the total area of the hull at the water line, this hull area being defined as W/d for respective hulls while taking into account the cross-sectional shape of the hull beneath the water line which gives the hull its forwardly-lying pitching center.

10 Claims, 2 Drawing Sheets

PITCH STABILIZED DISPLACEMENT VESSEL

BACKGROUND OF THE INVENTION

1. Field of the Invention

The present invention relates to a pitch stabilized, high-speed displacement vessel with which the pitching movement center of the hull is located in the midship area of the hull or forwardly of the midship area.

In conventional seagoing displacement vessels, the center of pitching motion of the hull has been located more towards the stern of the hull than towards the bows.

By pitching movement is meant the movement of the vessel or hull in its vertical midship plane as the vessel moves through the water. As the vessel moves through the water, it is also subjected to heaving movement, which can be considered as the vertical, parallel displacement to which the vessel is subjected as it follows the waves up and down.

Thus, the vertical acceleration forces that act on the vessel at a given point are determined partly by heave and partly by pitch, i.e. the angular acceleration of the vessel times the lengthwise distance between the center of pitching movement of the vessel and said given point.

Pitching movement, i.e. angular acceleration of the vessel, is, of course, dependent on the forward speed of the vessel in relation to the speed and direction of the waves, the relative speed between wave and vessel playing an important part in the acceleration of the vessel pitching movement.

Vertical movement of a seagoing vessel, and particularly vertical acceleration, is considered to be the greatest contributory factor to seasickness and it has been found generally that conventional catamarans whose center of pitching movement is located far out towards the stern and which are propelled at high speeds are extremely liable to subject passengers to powerful vertical acceleration forces. Naturally, it is also highly disadvantageous to subject the cargo of a vessel to pronounced vertical movements and to vertical acceleration forces in particular.

2. Description of related Art

In conventional displacement vessels, the height of the hull above the water and the pitching tendencies of the hull can be controlled with the aid of active stabilizing fins, which are controlled with the aid of sensors that detect the vertical acceleration of the vessel. Such control systems, however, are unsuitable for several reasons. For instance, the system must be capable of working very rapidly and includes movable fins which are sensitive to their own movement and which must be subjected to very powerful forces if they are to have any appreciable effect. Any malfunction of the fins or of the fin control system will place the vessel and the passengers at great risk and may have disastrous consequences should the malfunction occur at high speeds, for instance speeds of 35 knots, and in heavy seas.

The object of the present invention is to provide a seagoing vessel, preferably a multi-hull vessel, and more preferably a vessel of the catamaran type, in which the hull is a displacement hull and is constructed for propulsion at high speeds and in significant wave heights, for instance wave heights of 5 meters or higher. A vessel of this kind may have a length of 120 meters and width of 40 meters.

In accordance with one proposed construction of long, slim displacement hulls intended for high-speed seagoing vessels, for instance multi-hull vessels of the catamaran type, the forward part of the hull has a bulbous underwater body and a relatively narrow waterline-width, so that the forward part of the hull will have a hull shape similar to the hull shape of so-called SWATH-vessels, while the rearward part of the hull has a more rectangular cross-sectional shape. In this regard, the cross-sectional area of the hull located beneath the water line may vary along its length to a lesser extent than in the case of conventional high-speed seagoing vessels, and the cross-sectional shape of the hull may change generally continuously between the two aforesaid cross-sections.

The aforementioned hull configuration, developed by Applicants, is described in more detail in Patent Publication SE-A-9100288-1 (see U.S. Pat. No. 5,269,245) to which reference is now made for more detailed information relating to a hull configuration that can be taken as a suitable starting point for particularly favourable application of the present invention.

A hull which has the configuration taught by publication SE-A-9100288-1 obtains a center of pitching movement which is located relatively far forwards, namely in the midship region of the hull or forwardly thereof, for instance in a position corresponding to 75% of the length of the hull as measured from the stern of the hull, while the hull is well adapted for high forward speeds and can be advantageously fitted with water-jet units and is able to withstand heavy loads. Other advantages afforded by a hull of this configuration are disclosed in the aforesaid patent publication.

The invention is defined in the following claim 1 and further developments of the invention are defined in the subordinate claims.

SUMMARY OF THE INVENTION

The invention has as its starting point a hull whose center of pitching movement is located in the midship region of the hull or forwardly thereof, said hull being constructed for high forward speeds and being a displacement hull. On the basis of a hull of this construction, the invention is characterized in that the vessel is provided with fixed fins or wings rearwardly of its center of pitching movement, and in that the fins or wings extend from the actual hull in a manner to present considerable resistance to displacement of the sternward part of the hull in a vertical direction. The fins or wings project relatively slightly from the hull and have a relatively long length, so that the point of attachment of the fins to the hull will be subjected to only relatively small bending forces despite a large total force transfer, and the wings or fins may have a sharp outer edge which will provide a high force transfer between the wing or the fin and the surrounding mass of water.

Because the fins are located stern-wise of the pitching center of the vessel and at a relatively large mean distance from said center, the fins provide powerful, pitch-damping torque in the vertical plane around said pitching center, while the fin attachments will be subjected solely to relatively low loads, despite the fact that the fins are able to transfer large loads because of their relatively long lengths. The fins also have a cross-sectional shape which will offer only slight resistance to flow in the longitudinal direction of the vessel, not least because the fins follow the stream lines adjacent to and along the hull.

Because the fins/wings are located rearwards of the center of pitching movement, the fins/wings will provide a desirable restoring moment as the vessel pitches during its movement through the water, despite the fins/wings being fixed. Further, the wings/fins provide an overcritical relationship with regard to pitching movement, which is highly desirable.

The total horizontally projected area of the heaving movements of the vessel will preferably be at least 5% of A=W/d, where W is the total underwater volume of the construction draft of the hull, and d is the construction draft of the hull. The projected area will preferably be at least 10% of A. The geometric aspect ratio AR for the stabilizing fin is greater than 0.01, preferably greater than 0.02, but smaller than 0.1, where AR (Aspect, Ratio) is S/C, where S is the horizontally projected span of each individual wing as measured transversely to the flow direction, i.e. from the hull itself, to the mean value of the outermost edge of the wing, and where C is the mean value of the chord length of the wing as measured in the flow direction. According to the present invention, the wings/fins may be placed symmetrically around the hull or around respective hulls, with the rearward, or sternward, edge of the wings coinciding essentially with the stern-edge of the hull.

The stabilizing fin may be configured to define an angle of between 0°–60° with the horizontal plane, in order to provide a course-stabilizing effect on the hull in the horizontal plane.

The pitching movement equation can be written as:

$$I.\ddot{\phi}+c.\dot{\phi}+k.\phi=0,$$

where

I=moment of inertia;

c=damping coefficient;

k=restoring moment; and $\phi$=pitching angle.

The following is achieved with the present invention:

In addition to including the vessel and its cargo, the moment of inertia I also includes the so-called co-oscillating water mass. The co-oscillating water mass is now increased considerably by the inventive wings/fins. In turn, this means that the natural frequency period, or resonance frequency, of the vessel will increase together with the co-oscillating water mass. This is highly significant, since the vessel plus the co-oscillating water mass in meeting or oncoming waves will obtain a natural period which is much longer than the so-called meeting period. In other words, the vessel coupled to the co-oscillating water mass will be unable to keep up with those movements that are imparted to the vessel by the oncoming or meeting waves, and the vessel will thereby obtain a supercritical course which will always produce the smallest accelerations.

The damping coefficient is increased, because the water in the vertical direction is forced to flow around the sharp and long edge of respective stabilizing wings/fins. An increase in damping coefficient results in decreasing amplitudes, i.e. a reduction in vessel acceleration.

Since the fins are positioned rearwardly of the hull pitching center, the fins obtain during pitching motion an angle of attack which produces a restoring moment that strives to reduce the angle of pitch.

The invention thus provides an improvement of all three factors I, c and k and means that in a practical construction the vertical acceleration at the stern-edge of the hull has been reduced to the order of 50% of the vertical acceleration of the hull in the absence of the invention, this comparison relating to a hull of the preferred embodiment described in SE-A-9100288-1.

A preferred embodiment of the invention can be said to lie in the selection of a slim, high-speed, displacement hull of the kind suitable for multi-hull vessels, such as catamarans, and which have been given a center of pitching movement in the forward half of the hull, and in the provision of wings or fins which are located rearwardly of the pitching center and project slightly out from the actual hull itself and which have a long length and a total horizontally projected area of at least 5% of A as hereinbefore defined, said wings or fins having a sharp outer edge which functions to counteract vertical movements in the water.

The invention and further developments thereof are defined in the following claims.

BRIEF DESCRIPTION OF THE DRAWINGS

The invention will now be described in more detail with reference to exemplifying embodiments thereof and also with reference to the accompanying drawings, in which.

DESCRIPTION OF THE PREFERRED EMBODIMENTS

Figure 1:
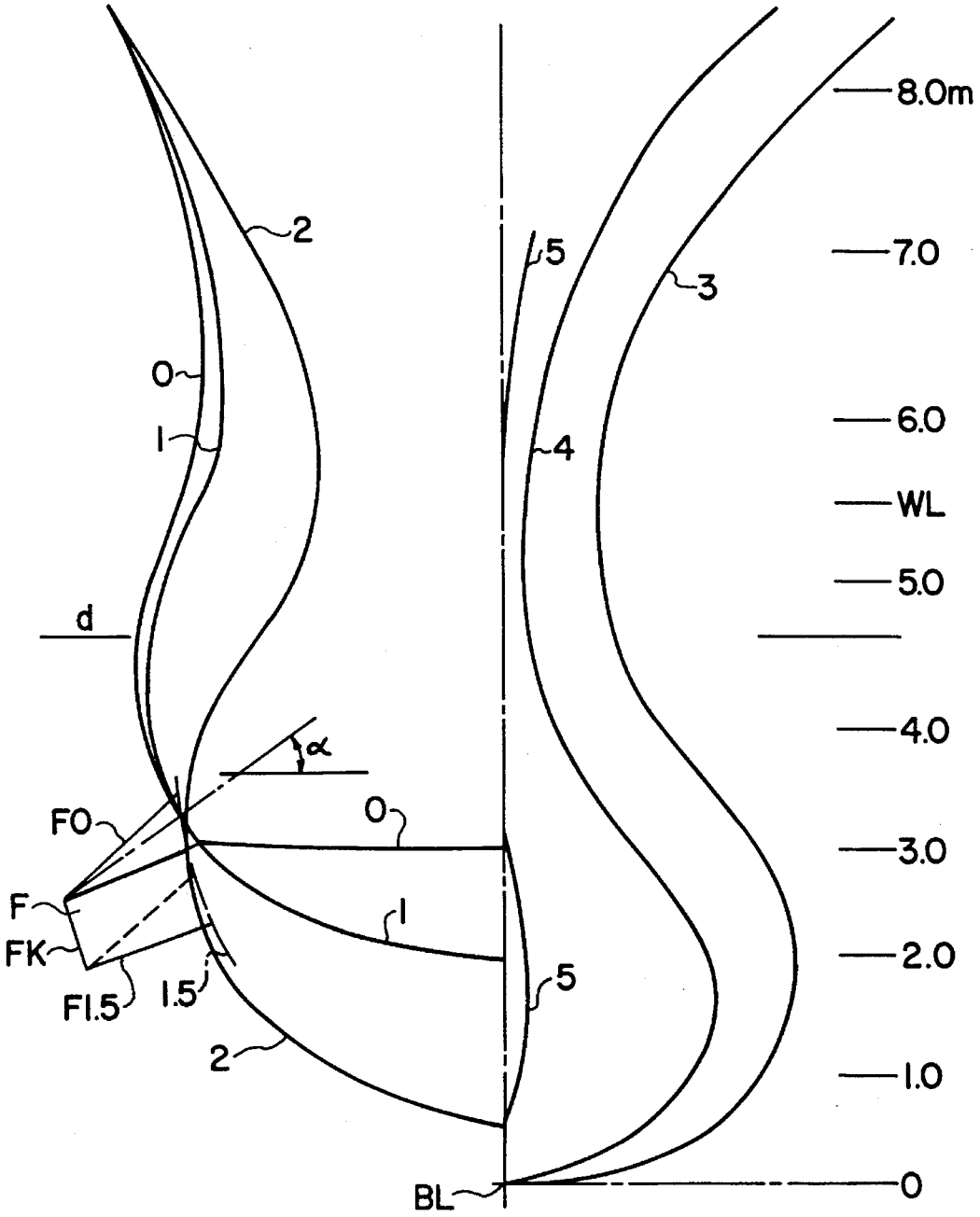
FIG. 1 is a schematic body plan of a hull which has its pitching center located far forwards and which is provided with fins in accordance with the invention.

FIG. 1 is a schematic body plan of an inventive pitch stabilized hull, said drawing illustrating one-half of a respective frame square. The illustrated body plan shows the construction draft d and gives the hull water line WL in absolute numbers for a hull having a length of about 120 meters. FIG. 1 illustrates the frames 0, 1, 2, 3, 4 and 5, the stern frame being frame number 0 and the foremost frame being frame number 5.

Also shown in FIG. 1 is a pitch stabilizing fin F which extends from the stern frame 0 to a position located between frames 1–2. The fin F projects through a distance of about 1 meter from the actual hull and is formed by two flat surfaces which define a top angle of about 10° therebetween. The median plane of the fin defines an angle $\alpha$ of 35° with the horizontal, although this angle e can be chosen relatively freely. The primary function of the fin is to prevent the hull from moving vertically in the water, although the fin may also define an angle with the horizontal plane so as to impart a steering effect to the hull.

As will be seen from FIG. 1, the fin F has a sharp outer edge FK, so that the fin F will counteract vertical movement in the surrounding water to the greatest possible extent.

It will also be seen from FIG. 1 that the fin F slopes upwards in a stern-wise direction, the extension of the fin F being caused to coincide to the stream lines of the water along the hull when the fin operates at the speed for which the hull has been optimized. This dimensioning speed is about 35 knots in the case of seagoing vessels of the kind concerned.

Figure 2:
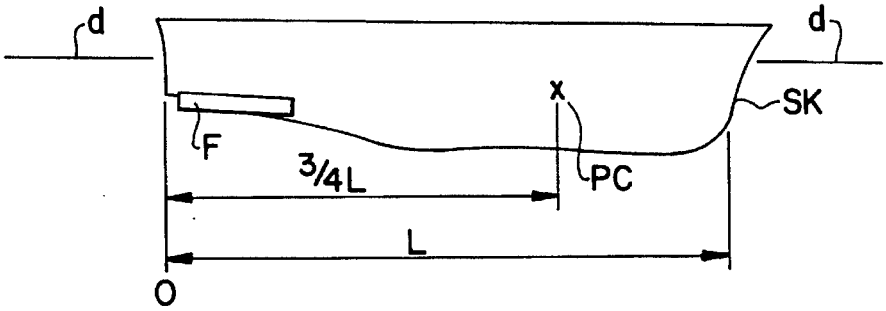
FIG. 2 is a schematic side view of hull illustrated in FIG. 1.

As will be seen from FIGS. 1 and 2, the illustrated hull SK has a pitching movement center PC which is located far forwards, approximately at the distance ¾ L from the stern frame 0 of the hull, L being the length of the hull. PC is thus located roughly at frame 3.75.

The fin F is fixed and is preferably mounted as far as possible rearwards of PC, so that the resistance presented by the fin to vertical movement of the hull will produce the largest possible pitch-counteracting torque about PC. The fin F will therefore preferably extend forwards from the stern frame 0 and is preferably located in the stern part/half of the hull SK, said fin also being located rearwardly of PC. The hull fins have a total horizontally projected area which is at least 5% and preferably at least 10% of A, where A=W/d, wherein W is the total underwater volume at construction draft and d is the construction draft. The geometric aspect ratio of the fin is defined as S/C, where S is the horizontally projected span of each individual fin, as measured transversely to the flow direction, i.e. from the actual hull to the mean value of the outermost edge of the stabilizing fin, and where C is the mean value of the chord length of the surface as measured in the flow direction. AR will preferably be smaller than 0.1 and larger than 0.01, preferably larger than 0.02. In the case of the FIG. 1 embodiment, AR=S/C is roughly equal to 0.03.

In the case of the FIG. 1 embodiment, A=18%. Swedish Patent Application 9100288-1 describes in more detail an example of a particular hull configuration designed to achieve a pronounced reduction in the vertically acting acceleration forces, particularly those forces that act on the forebody of the vessel, and can be considered to constitute the hull on which the invention is based, wherein the fins arranged in accordance with the present invention provide a pronounced reduction in the vertically acting acceleration forces at the stern of the hull.

Figure 3:
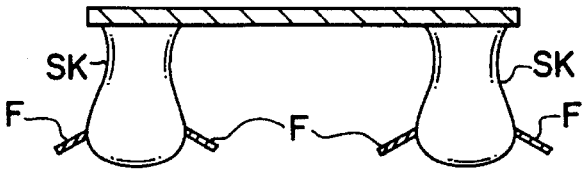
FIGS. 3 and 4 illustrate alternative placements of fins on the hulls of a catamaran-type vessel.
Figure 4:
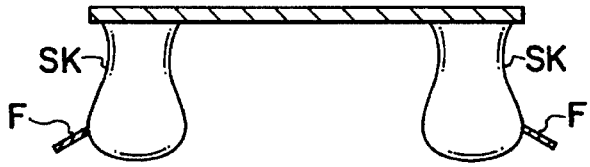
Figure 5:
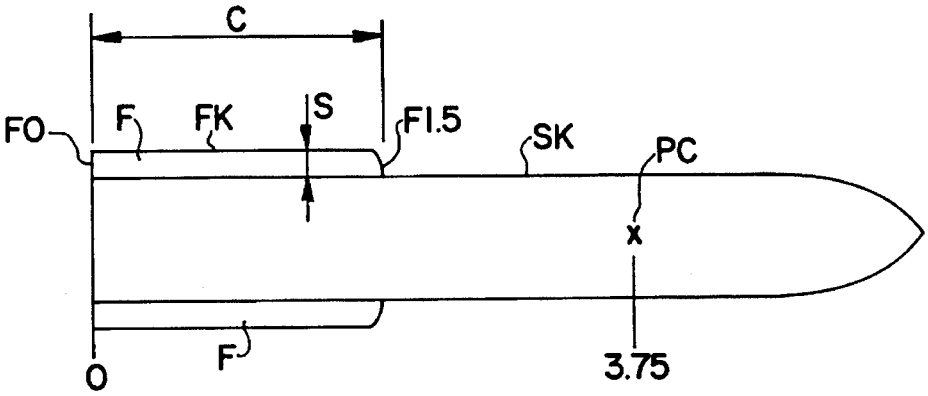
FIG. 5 is a schematic horizontal view of an inventive hull.

FIG. 3 is a schematic end view of a twin-hull seagoing vessel, particularly of the catamaran type, wherein fins are disposed symmetrically on each hull. FIG. 4 illustrates a construction of a vessel which has symmetrically arranged fins, although only on one side of respective hulls.

In FIG. 1, the forward end of the fin F has been identified by F 1.5 to indicate that this end of the fin lies in the proximity of frame 1.5. Correspondingly, the rear edge of the fin F has been identified by F 0 to indicate that this edge lies in the proximity of frame 0.

The fin F will preferably have an essentially constant cross-section profile along the whole of its length, but will preferably narrow towards both of its ends, so as to minimize the resistance to flow along the end-parts of the fin, this narrowing of the end-parts of the fin being implemented with regard to the width and/or thickness of the fin. The fin may also have a sharp outer edge FK in the region where it narrows. The fin F illustrated in FIGS. 1 and 2 is curved slightly in its longitudinal direction and slopes slightly upwards/rearwards so as to lie in the stream line of the water along the hull in normal operation. In the FIG. 1 embodiment, the sloping part of the fin F is located essentially between frame 1.5 and frame 1, whereas the part of the fin located between frame 1 and frame 0 is essentially horizontal, this fin extension being related to the hull configuration illustrated in FIG. 1, which coincides essentially with the hull design according to SE-A-9100288-1. The illustrated fin F has a length which corresponds to one-third of the hull length L, and the notation BL in FIG. 1 indicates the hull base line, i.e. a line which extends parallel with the hull water line and which passes through the lowest point of the actual hull.

We claim:

1. A pitch stabilized, high-speed vessel comprising:

at least one hull of a displacement type constructed so as to have a pitching center of the at least one hull no further rearward than a midship region of the at least one hull; and at least one fixed fin mounted rearwardly of said pitching center and projecting generally horizontally from the at least one hull;

the at least one fixed fin extending along water stream lines defined along the at least one hull in operation;

the at least one fixed fin having a total horizontally projected area which is equal to at least 5% of W/d, wherein W is a total underwater volume at construction draft and d is said construction draft;

the at least one fixed fin having a geometric aspect ratio which is greater than 0.01, smaller than 0.1 and equal to S/C, wherein S is a horizontally projected span of each individual surface, as measured transversely to a flow direction from the at least one hull to a mean value of an outermost edge of the at least one fixed fin, and C is a mean value of a chord length of said individual surface as measured in the flow direction.

2. A vessel according to claim 1, characterized in that the at least one fixed fin has a total area which is at least 10% of W/d.

3. A vessel according to claim 1, characterized in that the aspect ratio (AR) is greater than 0.02 but smaller than 0.1.

4. A vessel according to claim 1, characterized in that the at least one fixed fin is mounted on a stern half of the vessel.

5. A vessel according to claim 1, characterized in that the pitching center is located at a point which lies essentially three-quarters of a length of the hull from a stern of the hull.

6. A vessel according to claims 1, characterized in that the vessel has at least two fins, and in that the fins are placed symmetrically on the at least one hull of the vessel.

7. A vessel according to claim 1 characterized in that a stern-edge of the at least one fixed fin coincides essentially with a stern-edge of the vessel.

8. A vessel according to claim 1, characterized in that the at least one fixed fin defines an angle (e) of 0°–60° with a horizontal plane.

9. A vessel according to claim 1, characterized in that the at least one fixed fin has a sharp outer long edge around which water flows generally vertically as the vessel pitches.

10. A vessel according to claims 1, characterized in that the at least one hull of the vessel is slim and designed for high-speed propulsion and in that the vessel includes two mutually parallel hulls arranged side-by-side in catamaran configuration.

* * * * *